US009989312B2

(12) United States Patent
Spink et al.

(10) Patent No.: US 9,989,312 B2
(45) Date of Patent: Jun. 5, 2018

(54) CHANNEL INDUCTOR

(71) Applicant: BLUESCOPE STEEL LIMITED, Melbourne, Victoria (AU)

(72) Inventors: John Anthony Spink, New South Wales (AU); Nega Setargew, New South Wales (AU); William Joseph Gleeson, Victoria (AU); Darren Kenneth Thompson, Victoria (AU); Craig Roulston, New South Wales (AU)

(73) Assignee: Bluescope Steel Limited, Melbourne, Victoria (AU)

( * ) Notice: Subject to any disclaimer, the term of this patent is extended or adjusted under 35 U.S.C. 154(b) by 70 days.

(21) Appl. No.: 14/773,668

(22) PCT Filed: Mar. 6, 2014

(86) PCT No.: PCT/AU2014/000217

§ 371 (c)(1),
(2) Date: Sep. 8, 2015

(87) PCT Pub. No.: WO2014/134679

PCT Pub. Date: Sep. 12, 2014

(65) Prior Publication Data

US 2016/0040934 A1 Feb. 11, 2016

(30) Foreign Application Priority Data

Mar. 7, 2013 (AU) ..... 2013900796

(51) Int. Cl.
*H05B 6/16* (2006.01)
*F27D 1/00* (2006.01)
(Continued)

(52) U.S. Cl.
CPC ..... *F27D 1/0006* (2013.01); *F27B 14/065* (2013.01); *F27B 14/08* (2013.01);
(Continued)

(58) Field of Classification Search
CPC .... F27D 1/0006; F27D 1/0009; F27B 14/065; F27B 14/14; F27B 14/08;
(Continued)

(56) References Cited

U.S. PATENT DOCUMENTS 4,900,249 A * 2/1990 McCollum ..... F27D 1/00 373/155
5,979,720 A * 11/1999 Nomura ..... B22D 41/54 266/280

FOREIGN PATENT DOCUMENTS

| | | |
|---|---|---|
| EP | 0152679 | 8/1985 |
| WO | 1998/058220 | 12/1998 |
| WO | 2011/120079 | 10/2011 |

OTHER PUBLICATIONS

International Preliminary Report on Patentability for Application No. PCT/AU2014/000217 dated Jul. 6, 2015 (7 pages).
(Continued)

*Primary Examiner* — Hung D Nguyen
(74) *Attorney, Agent, or Firm* — Michael Best & Friedrich LLP

(57) ABSTRACT

A channel inductor of a channel induction furnace, the channel inductor comprising (a) a channel liner and (b) a back-up liner that supports the channel liner such that the integrity of the channel liner is not compromised during heat-up, dry-out, or operation of the channel induction furnace.

10 Claims, 3 Drawing Sheets

(51) Int. Cl.
*H05B 6/20* (2006.01)
*F27B 14/06* (2006.01)
*F27B 14/08* (2006.01)

(52) U.S. Cl.
CPC ..... *F27D 1/0009* (2013.01); *H05B 6/20* (2013.01); *F27B 2014/066* (2013.01); *F27B 2014/0812* (2013.01); *F27B 2014/0843* (2013.01)

(58) Field of Classification Search
CPC ..... F27B 2014/0843; F27B 2014/066; F27B 2014/0812; H05B 6/20; H05B 6/34
USPC ..... 373/155, 159, 161, 162, 163, 164
See application file for complete search history.

(56) References Cited

OTHER PUBLICATIONS

International Search Report for Application No. PCT/AU2014/000217 dated May 19, 2014 (3 pages).

* cited by examiner

CHANNEL INDUCTOR

FIELD OF THE INVENTION

The present invention relates to channel inductors of channel induction furnaces.

In particular, the present invention relates to channel liners of channel inductors.

The present invention also relates to channel inductor furnaces.

BACKGROUND TO THE INVENTION

Channel induction furnaces are used in industries for melting a metal (which term includes metal alloys) and maintaining the metal in a molten state. For example, channel induction furnaces are used in galvanising and foundry industries for melting Zn-containing alloys and Al-containing alloys, including Al/Zn-containing alloys, and maintaining the alloys in a molten state.

A known channel induction furnace comprises (a) a steel shell, (b) a lining of a refractory material, such as an aluminosilicate, internally of the shell, (c) a pot for containing a bath of molten metal that is defined by the refractory-lined shell, and (d) one or more than one channel inductor for heating metal that is connected to the shell and in fluid communication with the pot via a throat that extends through the refractory-lined shell to an inlet in the channel inductor.

The channel inductor comprises (i) a steel shell, (ii) a lining of a refractory material, such as an aluminosilicate, (iii) a channel defined by the refractory-lined shell that forms a path for molten metal to flow from the pot through the channel and back into the pot, and (iv) an electromagnetic coil which generates an electromagnetic field. At any given time during the operation of a channel induction furnace, molten metal in the channel of the channel inductor becomes a secondary circuit of a transformer and is heated and kept molten by currents induced by the electromagnetic field. The channel inductor is a bolt-on assembly on the shell of a channel induction furnace. The refractory material that so forms the lining is selected to accommodate a range of specific mechanical requirements, thermal insulation requirements, and resistance to chemical attack by molten metal. These requirements are competing requirements to a certain extent in the sense of needing different material properties and hence the selection of the refractory material tends to be a compromise.

Channel inductors have a limited life when exposed to molten metals such as Zn-containing and Al-containing alloys and typically fail in the following modes:

- Cracking of the refractory material, particularly along central planes of channel inductors, during heat-up, dry-out, or operation, and subsequent penetration of Zn and/or Al metal or Zn vapours into the cracks which extend the cracks, ultimately resulting in a metal leak from the channel inductors.
- Additionally, in the case of Al-containing alloys, by reduction of $SiO_2$ in the refractory material by Al, thereby forming $Al_2O_3$ and Si, with an associated reduction in the volume of the refractory material and penetration and/or spalling of the refractory material.
- Additionally, blocking due to adherence of corundum growth within the channel, which is compounded by pieces of altered refractory or dross from a pre-melt pot main area entering the channel.

Typically, the life of channel inductors in Al-containing alloys is 6-24 months and is one of the main reasons for metal coating line shut-downs.

The applicant is developing a new inductor having greater reliability and, more particularly, less tendency so to fail due to cracking.

The new inductor is described in International publication WO2011/120079 in the name of the applicant.

The channel inductor that is described and claimed in the International publication comprises (a) a channel liner that is formed from a refractory material that is resistant to chemical attack by the molten metal in the channel and is the only material of the channel inductor that is in direct contact with the molten metal and (b) a back-up liner that supports the channel liner and is formed from a refractory material that is optimal for thermal insulation material properties and mechanical strength properties, such that the integrity of the channel liner and is not compromised during heat-up, dry-out, or operation of the channel induction furnace.

A channel inductor made with a channel liner and a back-up liner in accordance with the invention of the International publication was found to have issues with cracking when used on a manufacturing plant of the applicant for coating steel strip with Zincalume® molten metal.

The applicant has investigated the causes of the cracks and the present invention was made in the investigation.

The above discussion is not intended to be a statement of the common general knowledge in Australia and elsewhere.

SUMMARY OF THE INVENTION

The applicant carried out a post mortem on the channel inductor made in accordance with the invention of the International publication that was used on the manufacturing plant of the applicant and made the following findings, which are the basis of the present invention.

1. It is beneficial to select the refractory material of the channel liner so that there is a chemical reaction between the material and the molten metal in the furnace that results in the channel liner becoming more resistant to further penetration by molten metal and resistant to blockages developing within the channel. Typically, the chemical reaction results in the formation of a denser phase in the channel liner. Typically, the original material includes silicon carbide blended with a corundum mineral when the molten material is an Al/Zn-containing alloy that contains sodium. Sodium may act as a catalyst for the chemical reaction.
2. It is beneficial to select the material for the back-up liner to be capable of absorbing stresses due to expansion and movement of the channel liner. Typically, the materials selection also includes selecting a material that is capable of resisting cracking due to thermal stress throughout the operating temperature range and also resistant to some reaction with the alloy which may reach the back up liner. Therefore, selection of material with the appropriate sintering characteristics and resistance to attack by the molten alloy is an important consideration. Typically, the material may be a dry vibratory material such as a Dri-Vibe® composite materials produced and marketed by Allied Minerals Products, Inc, for example as described in European patent 1603850 in the name of that company. Typically, the Dri-Vibe® materials may be metal fibre, which typically includes metal fibre reinforced aluminosilicate refractory composite materials, with the refractory material component of the composite containing 60-95 wt. % alumina, preferably 60-70 wt. % alumina and 20-35 wt. %

In broad terms, the present invention provides a channel inductor of a channel induction furnace, the channel inductor comprising (a) a channel liner and (b) a back-up liner that supports the channel liner such that the integrity of the channel liner is not compromised during heat-up, dry-out, or operation of the channel induction furnace.

In the context of item 1 above, the material of the channel liner may be selected so that there is a chemical reaction between the material and the molten metal in the furnace that results in the channel liner becoming more resistant to further penetration by molten metal and resistant to the development of blockages due to corundum growth within the channel. The material may be otherwise as described in item 1.

In the context of item 2 above, the material of the back-up liner may be selected to be capable of absorbing stresses due to expansion and movement of the channel liner. The material may be otherwise as described in item 2.

The channel liner may be any suitable shape.

The channel liner may be an elongate unit with the channel being in the shape of a single U ("single loop inductor"). More particularly, the channel may comprise two arms extending from a base of the channel, with a molten metal inlet in an end of one arm of the channel and a molten metal outlet in an end of the other arm of the channel, whereby molten metal can flow through one arm to the base and through the base to the other arm and along the other arm.

The channel liner may be an elongate unit with the channel being in the shape of a double U. More particularly, the channel may comprise three arms extending from a base of the channel that interconnects the arms, with a molten metal inlet in an end of a central arm of the channel and molten metal outlets in the ends of the outer arms of the channel, whereby molten metal can flow through the inner arm to the base and outwardly through the base to the outer arms and along the outer arms.

The channel liner may have a top wall, with the inlet and the outlet(s) formed in the top wall, and with the mounting flange extending outwardly from the top wall.

The channel liner may comprise a side wall that extends from a perimeter of the top wall, with the mounting flange extending outwardly from an upper edge of the side wall. This arrangement defines a vestibule or a forebay.

The present invention also provides a channel inductor furnace that comprises:

(a) a steel shell, (b) a lining of a refractory material internally of the shell, (c) a pot for containing a pool of molten metal that is defined by the refractory-lined shell, and (d) one or more than one of the above-described channel inductor for heating a metal that is connected to the shell and in fluid communication with the pot via a throat that extends through the shell and the refractory lining to the inlet in the channel inductor.

The molten metal may be selected from the group comprising Zn-containing alloys and Al-containing alloys, including Al/Zn-containing alloys. These alloys are not confined to Al and Zn and may include other elements such as Ca.

DESCRIPTION OF THE DRAWINGS

The present invention is described further by way of example with reference to the accompanying drawings, of which.

DESCRIPTION OF EMBODIMENTS OF THE INVENTION

Figure 1:
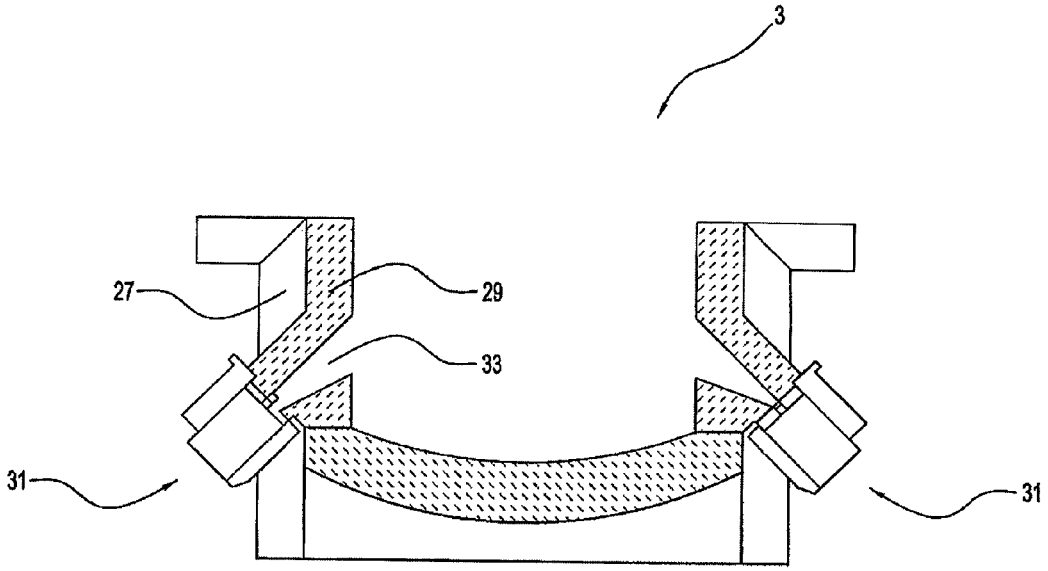
FIG. 1 is a vertical cross-section through one embodiment of a channel inductor furnace in accordance with the present invention that includes one embodiment of a channel inductor in accordance with the present invention.
Figure 2:
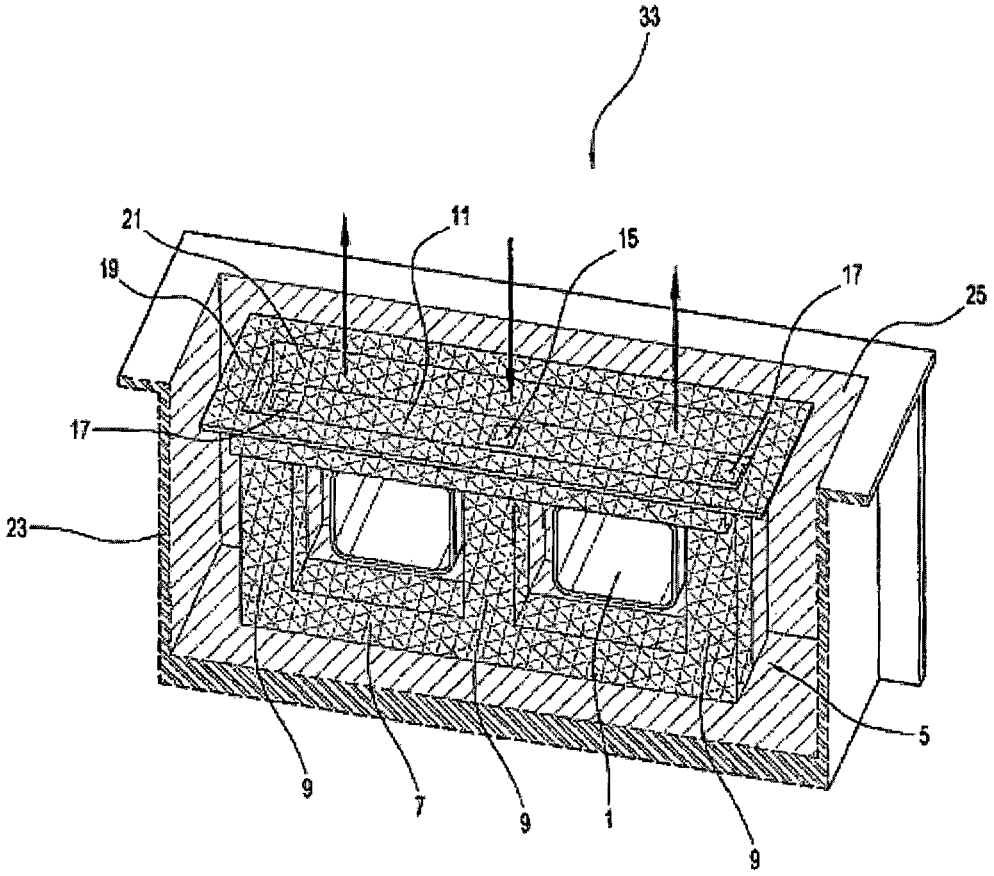
FIG. 2 is a vertical cross-section through one embodiment of a channel inductor in accordance with the present invention.

FIGS. 1 and 2 are the Figures of the above-mentioned International publication of the applicant.

FIG. 1 is a cross-section of the main components of a channel inductor furnace 3 for pre-melting an Al/Zn alloy for use in a metal coating line for steel strip. It is noted that the present invention is not limited to this end-use and may be used as part of any suitable channel induction furnace and for any suitable end-use application.

The channel inductor furnace 3 shown in FIG. 1 comprises a pot defined by an outer steel shell 27 and an inner lining 29 of a refractory material, such as an aluminosilicate. In use, the pot contains a bath (not shown) of a molten Al/Zn alloy. The furnace 3 also includes two channel inductors 31 that are connected to opposite side walls of the steel shell 27 and are in fluid communication with the bath via respective throats 33. In use, molten Al/Zn alloy flows from the bath and into and through the channel inductors 31 and is heated by the channel inductors 31.

The drawing of the channel inductor 31 in FIG. 2 a vertical cross-section in order to show the component; of the inductor that are particularly relevant to the present invention. In addition, in order to make these components as clear as possible, the electromagnetic coil of the inductor 31 is not included in the openings 1 in the drawing.

The channel inductor 31 comprises:

(a) a channel liner, generally identified by the numeral 5; and (b) a channel liner support assembly that supports the channel liner.

The channel liner 5 is a single piece elongate unit that defines the above-mentioned openings 1 and a double "U" shaped channel for molten Al/Zn alloy to flow through the channel inductor. The channel comprises a base and three parallel arms 9 extending from the base. The upper end of the central arm of the channel is an inlet 15 for molten Al/Zn alloy and the upper ends of the outer arms of the channel are outlets 17 for molten Al/Zn alloy. The base of the channel is defined by a base section 7 of the channel liner 5 and the arms of the channel are defined by upstanding sections 9 of the channel liner 5. These sections 7, 9 are thin-walled, hollow sections. The channel liner 5 has a top wall 11, and the inlet 15 and the outlets 17 for molten Al/Zn alloy flow are formed in the top wall 11. The channel liner 5 also comprises a side wall 21 that extends around the perimeter of the top wall 11 and a flange 19 that extends outwardly from the side wall 21. The top wall 11 and the side wall 21 define a vestibule or forebay. The flange 19 is provided to mount the channel liner 5 to a refractory material lining (not shown) that defines a pot throat (not shown) of a pot (not shown) of the channel inductor furnace, whereby direct contact between molten Al/Zn alloy and the channel inductor is limited to contact with the channel liner 5 only.

The channel liner support assembly comprises (a) an outer steel shell 23 and (b) a back-up lining 25. The back-up lining 25 is not shown specifically in FIG. 2 in order to simplify the drawing. As indicated by the numeral 25 and the drawing line in FIG. 2, the back-up lining material fills the space between the shell 23 and the channel liner 5.

The present invention relates to the materials selection for the materials from which the channel liner 5 and the back-up lining 25 are made.

As indicated above, a channel inductor made in accordance with the above-mentioned International publication of the applicant was found to have issues with cracking when used on a manufacturing plant of the applicant.

The applicant carried out a post-mortem on the inductor and key points that emerged from the post mortem include the following points:

- There was significant reaction between the material of the channel liner 5 and the molten metal.
- This reaction progressed rapidly due to the presence of trace amounts of sodium in the molten metal that acted as a catalyst.
- The level of sodium was measured to increase in the material of the channel liner 5.
- The reaction was predominately with the SiC aggregate in the refractory material of the channel liner 5.
- One advantage of the SiC is that it produces less thermal stress in the composite structure on initial heating due to its lower coefficient of expansion in comparison to the normal high alumina material.
- As the SiC was consumed the coefficient of expansion of the material of the channel liner 5 increased—which may help in making a tighter structure at the hot face of the channel liner.
- The resultant hot face layer that developed in service resisted corundum build up/growth in the bore of the channel inductor.
- It is important for a suitable back-up lining 25 to be selected to support the channel liner 5.

The applicant made the following findings.

1. It is beneficial to select the refractory material of the channel liner so that there is a chemical reaction between the material and the molten metal in the furnace that results in the channel liner becoming more resistant to further penetration by molten metal and more resistant to channel blockage. Typically, the chemical reaction results in the formation of a denser phase in the channel liner. Typically, the material includes a source of silicon such as Silicon carbide when the molten material is an Al/Zn-containing alloy that contains trace sodium. Sodium may act as a catalyst for the chemical reaction.
2. It is beneficial to select the material for the back-up liner to be capable of absorbing stresses due to expansion and movement of the channel liner. Typically, the materials selection also includes selecting a material that is capable of resisting cracking due to thermal stress throughout the operating temperature range and also resistant to some reaction with the alloy which may reach the back up liner. Therefore, selection of material with the appropriate sintering characteristics and resistance to attack by the molten alloy is important. Typically, the material is a dry vibratory material metal fibre, such as steel fibre, reinforced aluminosilicate refractory composite materials, with the refractory material component of the composite containing 60-95 wt. % alumina, preferably 60-70 wt. % alumina and 20-35 wt. % silica

Channel Liner Material Selection

One observation in the post-mortem that was not expected from an initial laboratory assessment of the channel liner material prior to using the channel inductor in the manufacturing plant was the level of apparent reaction and densification of the channel liner material.

In laboratory testing of the channel liner material, minimal reaction was observed. In the case of the channel inductor used on the manufacturing plant, the majority of the channel liner 5 was penetrated by Zincalume® molten metal used on the plant to give a darker denser looking appearance. In the few locations where there was no penetration, the appearance of a cut face showed a porous texture suffering from grain pluck-out during sectioning as if the bond strength had been reduced.

The post-mortem indicated that there had been a reduction in the $SiO_2$ content of the channel liner material and an increase in sodium and zinc phases in the channel liner material. This indicates that there was a migration of Na and Zn vapour through the channel liner 5, ahead of the penetration of the Zincalume® molten metal, and these sodium and zinc phases lead to a reduction of silicate binding phase in the channel liner 5 which then aided further penetration.

The chemical analysis results for the penetrated, i.e. dense, zone of the channel liner 5 indicate a marked increase in $Al_2O_3$, ZnO, $SiO_2$ and $Na_2O$. The component that was significantly reduced was the SiC level. These changes in the dense phase are also reinforced by the XRD comparison. The XRD is semi-quantitative and must not be considered as an accurate number but it is a good indication of the species that are present in the penetrated liner and their comparative levels.

Some of the penetration phase was still in a metallic form with a combination of aluminium and aluminium silicon alloy. This was also evident in a microscopic examination. The presence of an Al/Sin alloy suggests there had been a chemical reaction between the refractory silicate phases of the channel liner 5 or reduction of the fine SiC in the matrix of the channel liner 5 to provide a source of silicon.

Both the XRD and chemical analysis indicate a reduction in the percentage of SiC in the dense phase. This may be due to an attack on the SiC or a dilution effect from the penetration into the refractory or a combination of both. There was some evidence that the dilution effect is a factor. This evidence includes a microscopic examination where the majority of larger SiC grains appeared to be unaltered and the presence of aluminium metal in the porosity of the refractory was an additional mass that would dilute the percentage of the original components. However, there was also some indication of a reaction occurring with some glassy phase surrounding some SiC grains on the outer surfaces. Also, minor components of the channel liner material such as Ba, Ti and Ca did not show a dilution effect in the altered channel liner and this supports a view that there was some reduction in the level of SiC through reaction.

In general, even though the channel liner 5 was penetrated by Zincalume® molten metal it become a denser $SiC/Al_2O_3$ containing composite with the reaction products and penetration metal making this composite even more compatible with the contact metal. One further encouraging observation was the lack of corundum growth or any other blockages in the channels and this suggests there is potential for this channel liner 5 to provide less problems with inductor blockages.

Figure 3:
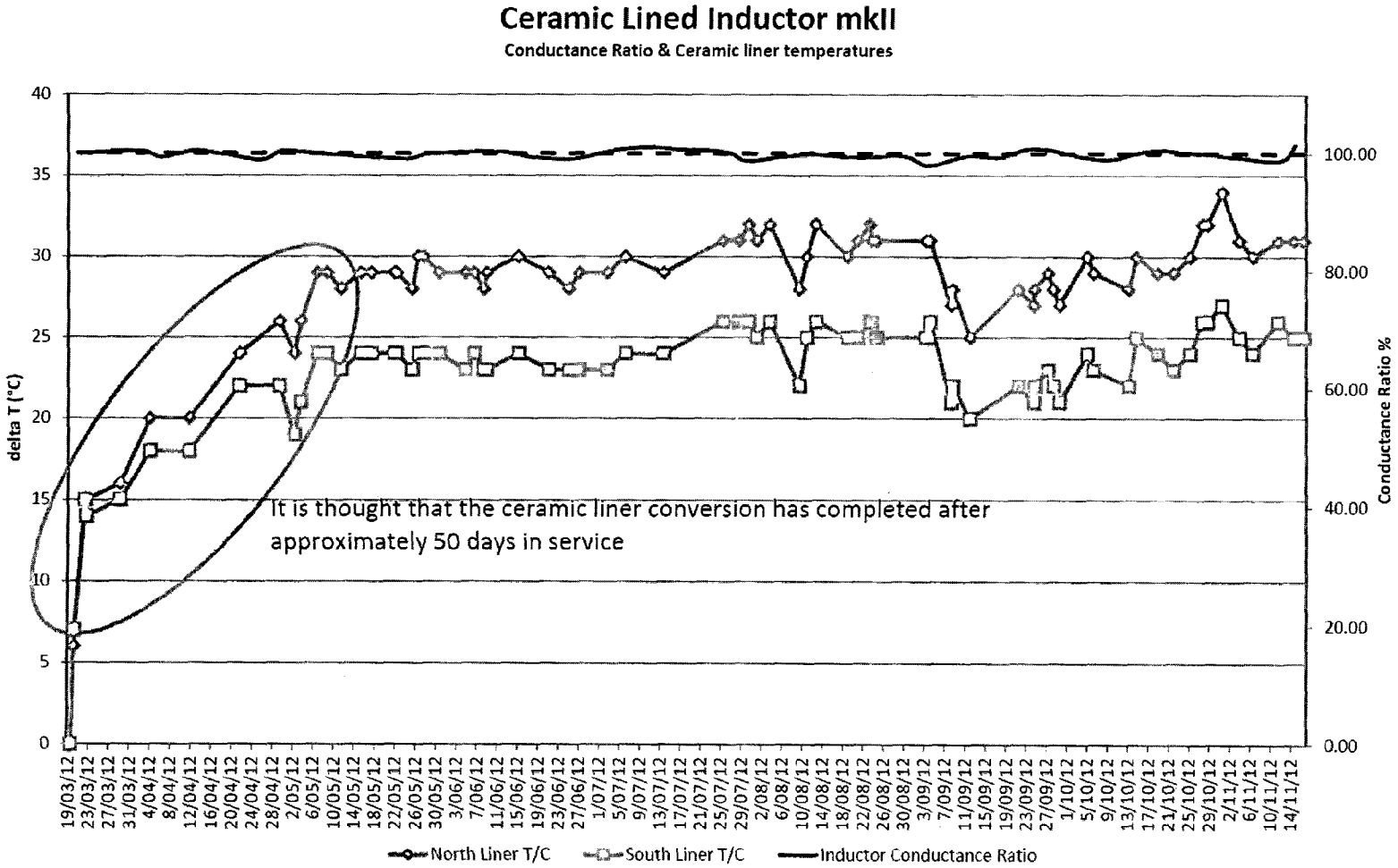
FIG. 3 is a graph of the temperatures of the channel liner and the back-up liner over the first 50 days of service of the channel inductor made in accordance with the invention of the International publication that was used on the manufacturing plant of the applicant. This Figure also shows the flat inductance ratio trend which is a measure of a lack of channel blockage in the inductor.

FIG. 3 is a graph of the temperatures of the channel liner 5 and the back-up lining 25 over the first 50 days of service of the channel inductor that as used on so the manufacturing plant. The increase in temperature in the early stages after start-up indicates that the channel liner material was being penetrated and there were reactions with the liner material which ultimately produced a more stable phase, which was relatively stable thereafter.

FIG. 3 also shows the conductance ratio was very stable for this inductor. The conductance ratio is a measure that indicates negligible channel blockage has occurred.

Dri-Vibe® Composite Material Test Work

The applicant carried out test work on Dri-Vibe® composite materials to evaluate the suitability of the materials. The test work is described below.

1. Introduction

The applicant tested three Dri-Vibe composite materials by exposing sample cups made from the materials to molten Zincalume® Al/Zn-containing alloy.

The three sample composite materials were supplied by Allied Minerals; Product A, Product B and Product C.

Product A and Product B materials are both mullite-based, metal fibre containing composite materials. Product C material is a fused alumina-based, metal fibre-containing composite material.

2. Sample Details

Product A: Two cups prepared by Allied, made by Allied with a Matripump 80AC castable back-up.

Product B: Two cups prepared by Allied, made by Allied with a Matripump 80AC castable back-up.

Product C: One cup prepared by Allied, made by Allied with a Matripump 80AC castable back-up.

3. Testwork

The samples were dried overnight.

The Zincalume metal alloy were cut to length and at least 5 cut sections were placed into each cup.

All of the cups were placed into the furnace.

The furnace was fired @ 5° C./minute to 600° C., then @2° C./min to 830° C., and then hold for 168 hours.

The furnace was allowed to cool and the samples were removed.

The 5 cup samples were cut in half.

Photographs of the cut faces were taken and evaluated—one half with the metal in place and the other half with the metal removed

TABLE 1

Summary of reactions in the cups.

| Material | Zincalume ® metal |
|---|---|
| Product A | One localized reaction area - possibly reacting with some stainless fibre. |
| Product B | Severe penetration by the Zincalume ® alloy. |
| Product C | No obvious reaction with Zincalume ® alloy. |

4. Discussion

On the basis of the tests, the Product B is not suitable for use as a back-up liner material in a channel inductor as it was heavily penetrated by Zincalume® metal.

Product C showed no reaction and would be suitable as a back-up liner 25 from a penetration resistance perspective. The higher alumina level in this material would give the material a higher thermal conductivity and so higher heat transfer to the coil area. This material also has a tighter texture and greater strength as it was supplied.

Product A performed well in the contact tests with both the Zincalume® metal It was also more friable in nature at the end of the test and is therefore likely to resist cracking from thermal stress and absorb stresses due to the expansion and movement of the channel liner 5. Because the material is mullite-based rather than alumina-based, it has a lower thermal conductivity than the Product C material and so will help to reduce the transfer of heat to the coil zones of channel inductors.

Many modifications may be made to the embodiment of the present invention described above without departing from the spirit and scope of the invention.

By way of example, the present invention is not confined to the particular shape of the channel inductor 3 shown in the drawing.

By way of further example, the present invention is not confined to a double "U" channel liner 5 and, by way of example, also extends to single "U" channel liners 5.

By way of further example, the present invention is not confined to a channel liner 5 that is formed as a single piece unit.

By way of a further example, present invention may be used as is or modified slightly for alloys that may contain other key elements such as magnesium.

The invention claimed is:

1. A channel inductor of a channel induction furnace for an Al/Zn alloy that contains sodium, the channel inductor comprising: (a) a channel liner in contact with molten alloy in the furnace, wherein the material of the channel liner includes a source of silicon in the original material of the channel liner, and the channel liner includes a denser phase formed as a result of a chemical reaction between the original material of the channel liner and the molten alloy, with the denser phase making the channel liner more resistant to penetration by molten alloy and more resistant to the development of channel blockages, and (b) a back-up liner that supports the channel liner such that the integrity of the channel liner is not compromised during heat-up, dry-out, or operation of the channel induction furnace, wherein the material of the back-up lining is an aluminosilicate refractory composite material that contains 60-95 wt. % alumina that is capable of absorbing stresses due to expansion and movement of the channel liner.

2. The channel inductor defined in claim 1 wherein the material of the back-up liner is also capable of resisting cracking due to thermal stress.

3. The channel inductor defined in claim 1 wherein the material of the back-up liner is a dry vibratory material.

4. The channel inductor defined in claim 1 wherein the aluminosilicate refractory composite material of the back-up liner has metal fibre reinforcing.

5. The channel inductor defined in claim 1 wherein the refractory material component of the composite contains 60-70 wt. % alumina and 20-35 wt. % silica.

6. The channel inductor defined in claim 1 wherein the channel liner is an elongate unit with the channel being in the shape of a single U.

7. The channel inductor defined in claim 1 wherein the channel liner is an elongate unit with the channel being in the shape of a double U.

8. The channel inductor defined in claim 1 wherein the material of the channel liner includes silicon carbide when the molten material is an Al/Zn-containing alloy that contains sodium.

9. The channel inductor defined in claim 1 wherein the material of the back-up lining is an aluminosilicate refractory composite material which has steel fibre reinforcing.

10. A channel inductor furnace that comprises:

(a) a steel shell, (b) a lining of a refractory material internally of the shell, (c) a pot for containing a pool of molten metal that is defined by the refractory-lined shell, and (d) at least one of the channel inductor for heating a metal that is defined in claim 1 and connected to the shell and in fluid communication with the pot via a throat that extends through the shell and the refractory lining to the inlet in the channel inductor.

* * * * *